United States Patent [19]

Ampferer et al.

[11] Patent Number: 4,974,569

[45] Date of Patent: Dec. 4, 1990

[54] CYLINDER BLOCK AND CRANKCASE

[75] Inventors: Herbert Ampferer, Sachsenheim; Rudolf Grandhuber, New-Ulm; Thomas Brachert, Wiernsheim, all of Fed. Rep. of Germany

[73] Assignee: Dr. Ing. h.c.F. Porsche AG, Fed. Rep. of Germany

[21] Appl. No.: 481,314

[22] Filed: Feb. 20, 1990

[30] Foreign Application Priority Data

Mar. 4, 1989 [DE] Fed. Rep. of Germany ..... 3907099

[51] Int. Cl.[5] ..... F02F 7/00; F02F 1/10; F02F 11/08

[52] U.S. Cl. ..... 123/193 C; 123/41.74

[58] Field of Search ..... 123/193 C, 41.86, 41.74, 123/41.79, 41.83, 41.84, 41.81

[56] References Cited

U.S. PATENT DOCUMENTS 4,561,388 12/1985 Gwinner et al. ..... 123/41.74
4,856,462 8/1989 Ushio ..... 123/41.84

FOREIGN PATENT DOCUMENTS 2911628 9/1980 Fed. Rep. of Germany .
59-85446 5/1984 Japan ..... 123/193 C
62-225751 10/1987 Japan ..... 123/193 C

*Primary Examiner*—Andrew M. Dolinar
*Assistant Examiner*—M. Macy
*Attorney, Agent, or Firm*—Evenson, Wands, Edwards, Lenahan & McKeown

[57] ABSTRACT

A combined cylinder block and crankcase for a multi-cylinder light-metal alloy internal-combustion engine has partitioning walls between the cylinders. The cylinders are surrounded by cooling-water channels. Combustion cylinder spaces are disposed between the combined cylinder block and crankcase and a cylinder head. In order to ensure that during the operation of the internal-combustion engine the cylinder diameters (adjacent to the combustion spaces) are kept within fixed tolerances specifically in the area of the partitioning walls, thermal-expansions slots are provided in the partitioning walls which lead to the cooling-water channels. These thermal-expansions slots are sealed off with respect to the cooling-water channels so that the partitioning walls are not impaired by cavitation.

20 Claims, 2 Drawing Sheets

CYLINDER BLOCK AND CRANKCASE

BACKGROUND AND SUMMARY OF THE INVENTION

The invention relates to a combined cylinder block and crankcase for a multi-cylinder internal-combustion engine which consists of a light-metal alloy and which has spaced cylinders provided with iron-metallic cylinder liners that have areas surrounded by cooling-water channels.

It is know.(DE-PS 29 11 628) to provide individual light-alloy air-cooled cylinders with thermal-expansion devices which counteract warping and bulging occurring in the area adjacent to the cylinder head.

It is an object of the invention to provide targeted thermal-expansion on a combined cylinder block and crankcase made of a light-metal alloy and which comprises several cylinders and cooling-water channels. Also the invention contemplates that despite this thermal expansion, the stability of the cylinder block and crankcase is maintained under load.

According to the invention this object is achieved by providing thermal-expansion devices at the cylinders adjacent to a cylinder head and combustion space. These thermal-expansion devices are formed by narrow thermal-expansion slots extending in partitioning walls between the cylinders and open to a partitioning plane between the combined cylinder block and crankcase and the cylinder head. The thermal expansion slots extend to the cooling water channels and are sealed off with respect to the cooling water by elastic sealing devices.

It is advantageous if the elastic devices are sealing bodies located in the area of ends of the thermal-expansion slots which border on the cooling-water channels. The sealing bodies have a circular cylindrical shape and rest in bores of the cylinder block and crankcase. The bores extend in parallel with respect to the central axes of the cylinders. The sealing bodies can consist of an elastomeric or plastic material.

Alternatively or additionally, the thermal expansion slots can be filled with a plastic material such as silicone, which is preferably poured into the thermal-expansion slots.

Advantages achieved by means of the invention are that, as a result of the thermal-expansion slots, temperature tolerances occurring during the operation of a light-metal alloy internal-combustion engine at the combined cylinder block and crankcase, are compensated. Measures are taken against any mechanical wear such as cavitation caused by the entering of cooling water into the thermal-expansions slots. To that end, elastic sealing devices are provided between the cooling channels and the thermal-expansion slots. This can be achieved in a simple manner by sealing bodies at ends of the slots and/or use of cushion-type plastic material which fill the thermal-expansion slots.

Other objects, advantages and novel features of the present invention will become apparent from the following detailed description of the invention when considered in conjunction with the accompanying drawings.

DETAILED DESCRIPTION OF THE DRAWINGS

Figure 1:
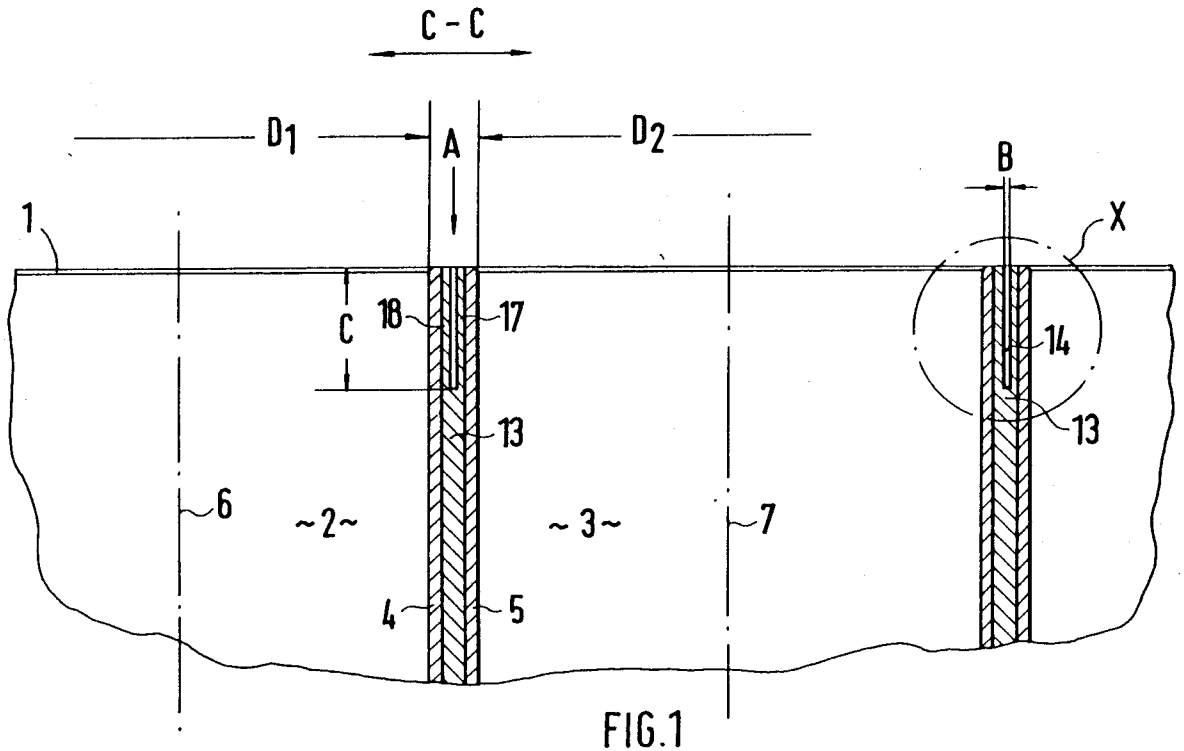
FIG. 1 is a partial longitudinal sectional view of a cylinder block and crankcase of an internal-combustion engine.

The combined cylinder block and crankcase 1 is a component of a reciprocating-piston internal-combustion engine (not shown in detail), which has several cylinders of the in-line construction type and operates according to the four-cycle principle. For reasons of weight, the combined cylinder block and crankcase 1 consists of a light-metal alloy. Iron-metallic cylinder liners 4, 5 are inserted into the individual spaced cylinders 2, 3. The central axes of cylinders 2, 3 are designated 6 and 7. In addition, the cylinders 2, 3 are surrounded by cooling-water channels 8, 9 over an essential partial area.

Figure 3:
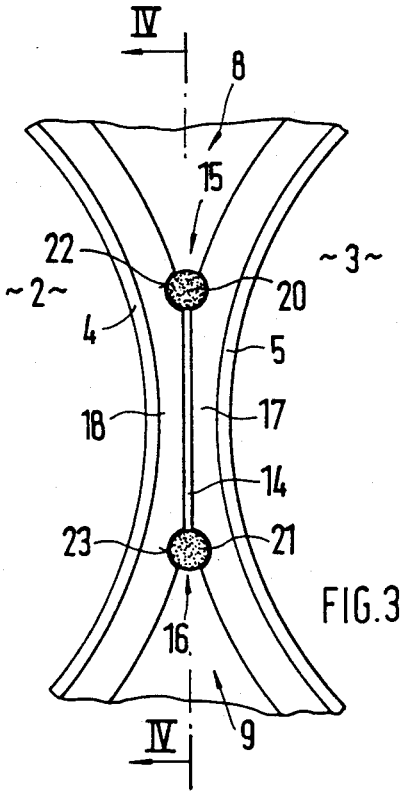
FIG. 3 is a view in the direction of arrow A of FIG. 1.
Figure 4:
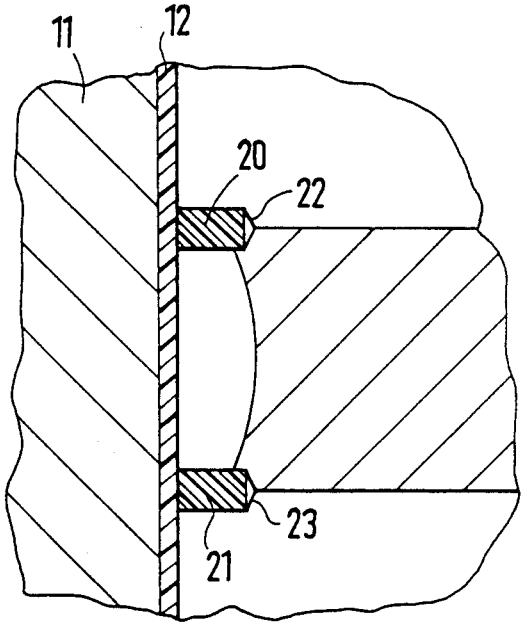
FIG. 4 is a sectional view according to Line I—I of FIG. 3.

In addition, the combined cylinder block and crankcase 1 is delimited by a partitioning plane 10 which extends between said combined cylinder block and crankcase and a cylinder head 11 (FIG. 4). The cylinder head has a sealing device 12 that extends in the positioning plane 10 between the combined cylinder block and crankcase 1 and the cylinder head 11. Combustion spaces supplying heat are provided on both sides of the partitioning plane 10 as a result of which upright partitioning walls 13 between cylinders 2, 3 are subjected to special stress caused by temperature. The partitioning walls 13 also separate the cooling water channels 8, 9. In order to compensate for the heat generated and in order to keep the diameters of the cylinders 2, 3 within fixed tolerances, thermal-expansion slots 14 are provided in the partitioning walls 13, extending transversely to the longitudinal direction C—C (FIG. 1) of the partitioning plane 10. These thermal-expansion slots 14 are created from the direction of the partitioning plane 10 by means of a mechanical process, such as milling, sawing or the like. The slots 14 are generally rectangular in cross-section. It is sufficient for the thermal-expansion slots 14 to be between 0.4 and 0.8 mm wide—measurement B (FIG. 1) and approximately 20 mm deep-measurement C (FIG. 1). The length of the slots 14 can be seen in FIG. 3.

Figure 2:
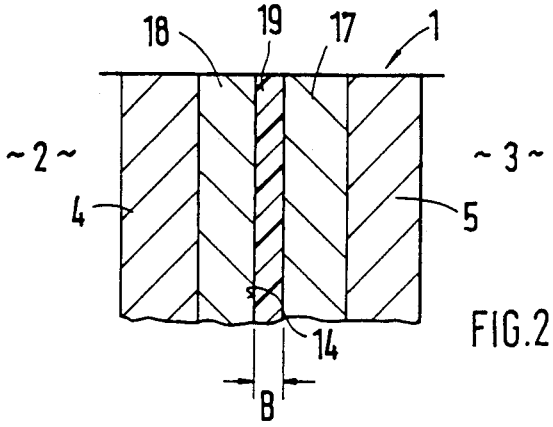
FIG. 2 is an enlargement of detail X of FIG. 1.

The two longitudinal ends 15, 16 of the thermal-expansion slots 14 terminate adjacent the cooling-water channels 8, 9. In order that the webs 17, 18 (defining the slots 14 in each partitioning wall 13) are not damaged by cavitation during the operation of the internal-combustion engine, the thermal-expansion slots 14 are sealed off from the cooling-water channels 8, 9 to prohibit the passage of cooling water into the slots 14. This may take place by essentially filling the thermal-expansion slots 14 with a cushion-type plastic material 19 (FIG. 2), such as silicone. The plastic material 19 may be inserted by pouring or by any similar method.

Sealing bodies 20, 21 are provided in the area of the longitudinal ends 15, 16 of the thermal-expansion slots 14. These sealing bodies 20, 21 consist of elastomeric or plastic material and prevent entry of cooling water into the thermal-expansion slots 14. The sealing bodies 20, 21 have a circular cylindrical shape and are fixed in corresponding bores 22, 23 which extend in parallel with respect to the central axes 6, 7 of the cylinders 2, 3.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A combined cylinder block and crankcase for a multi-cylinder light-metal alloy internal-combustion engine comprising:

multiple spaced cylinders with iron-metallic cylinder liners;

wherein the cylinders have areas surrounded by cooling-water channels;

thermal-expansion means at the cylinders adjacent to a cylinder head and engine combustion space;

wherein these thermal-expansion means are formed as narrow thermal-expansion slots extending in partitioning walls between the cylinders;

wherein the slots open toward a partitioning plane between the combined cylinder block and crankcase and the cylinder head; and wherein the cooling water channels are sealed off with respect to thermal expansion slots by elastic means to prevent entry of cooling water from the cooling water channel into the thermal expansion slots.

2. A combined cylinder block and crankcase according to claim 1, wherein the elastic means are provided in end areas of the thermal-expansion slots which border on the cooling-water channels.

3. A combined cylinder block and crankcase according to claim 1, wherein the elastic means have a circular cylindrical shape;

wherein the elastic means rest in bores in the combined cylinder block and crankcase and;

wherein the bores extend in parallel with respect to a central axis of the cylinders.

4. A combined cylinder block and crankcase according to claim 2, wherein the elastic means have a circular cylindrical shape;

wherein the elastic means rest in bores in the combined cylinder block and crankcase and;

wherein the bores extend in parallel with respect to a central axis of the cylinders.

5. A combined cylinder block and crankcase according to claim 1, wherein the elastic means are made from any one of an elastomeric and plastic material.

6. A combined cylinder block and crankcase according to claim 2, wherein the elastic means are made from any one of an elastomeric and plastic material.

7. A combined cylinder block and crankcase according to claim 3, wherein the elastic means are made from any one of an elastomeric and plastic material.

8. A combined cylinder block and crankcase according to claim 4, wherein the elastic means are made from any one of an elastomeric and plastic material.

9. A combined cylinder block and crankcase according to claim 1, wherein the elastic means includes a plastic material which is poured into the thermal-expansion slots.

10. A combined cylinder block and crankcase according to claim 2, wherein the elastic means includes a plastic material which is poured into the thermal-expansion slots.

11. A combined cylinder block and crankcase according to claim 3, wherein the elastic means includes a plastic material which is poured into the thermal-expansion slots.

12. A combined cylinder block and crankcase according to claim 4, wherein the elastic means includes a plastic material which is poured into the thermal-expansion slots.

13. A combined cylinder block and crankcase according to claim 5, wherein the elastic means includes a plastic material which is poured into the thermal-expansion slots.

14. A combined cylinder block and crankcase according to claim 6, wherein the elastic means includes a plastic material which is poured into the thermal-expansion slots.

15. A combined cylinder block and crankcase according to claim 7, wherein the elastic means includes a plastic material which is poured into the thermal-expansion slots.

16. A combined cylinder block and crankcase according to claim 8, wherein the elastic means includes a plastic material which is poured into the thermal-expansion slots.

17. A combined cylinder block and crankcase according to claim 1, wherein the plastic material is a silicon.

18. A combined cylinder block and crankcase according to claim 2, wherein the plastic material is a silicon.

19. A combined cylinder block and crankcase according to claim 3, wherein the plastic material is a silicon.

20. A combined cylinder block and crankcase according to claim 4, wherein the plastic material is a silicon.

* * * * *